US010213939B1

(12) United States Patent
Lui

(10) Patent No.: US 10,213,939 B1
(45) Date of Patent: Feb. 26, 2019

(54) METHOD FOR PRODUCING STONE INLAY TESSERAE

(71) Applicant: Sun Wah Lui, Hong Kong (HK)

(72) Inventor: Sun Wah Lui, Hong Kong (HK)

( * ) Notice: Subject to any disclaimer, the term of this patent is extended or adjusted under 35 U.S.C. 154(b) by 0 days.

(21) Appl. No.: 16/027,469

(22) Filed: Jul. 5, 2018

Related U.S. Application Data

(60) Provisional application No. 62/617,955, filed on Jan. 16, 2018.

(51) Int. Cl.

| | |
|---|---|
| ***B28B 11/12*** | (2006.01) |
| ***B28B 1/30*** | (2006.01) |
| ***B28B 17/00*** | (2006.01) |
| ***B28B 3/00*** | (2006.01) |

(52) U.S. Cl.
CPC ..... *B28B 1/30* (2013.01); *B28B 3/006* (2013.01); *B28B 11/12* (2013.01); *B28B 17/0036* (2013.01)

(58) Field of Classification Search
CPC .... B28B 1/30; B28B 1/29; B28B 1/14; B28B 1/008; B28B 1/16; B28B 1/26; B28B 11/14; B28B 17/0036; B28B 3/006; B28B 11/12
See application file for complete search history.

(56) References Cited

U.S. PATENT DOCUMENTS

| | | | | |
|---|---|---|---|---|
| 3,247,299 | A | 4/1966 | Zaha | |
| 4,085,181 | A * | 4/1978 | Cosentino | B29C 39/203 264/158 |
| 2007/0245682 | A1 | 10/2007 | Zheng | |
| 2017/0197332 | A1 * | 7/2017 | Gugbea | B28B 7/38 |

* cited by examiner

*Primary Examiner* — Vishal I Patel

(57) ABSTRACT

Provided is a method for producing stone inlay tesserae for forming a mosaic pattern surface, the method comprises the steps of: providing at least one core made from a natural stone material; providing a mold having an internal surface that defines an internal cavity for accommodating the at least one core, the internal cavity has a volume larger than that of the at least one core, such that an internal space is formed between the internal surface of the mold and the at least one core when the at least one core is placed within the mold; adding a molding composite into the mold to fill the internal space; solidifying the molding composite, thereby forming a hybrid tessera column comprising a stone inlay and an external layer seamlessly around the at least one core; demolding the hybrid tessera column from the mold; and cutting the hybrid tessera column into a plurality of stone inlay tesserae.

15 Claims, 12 Drawing Sheets

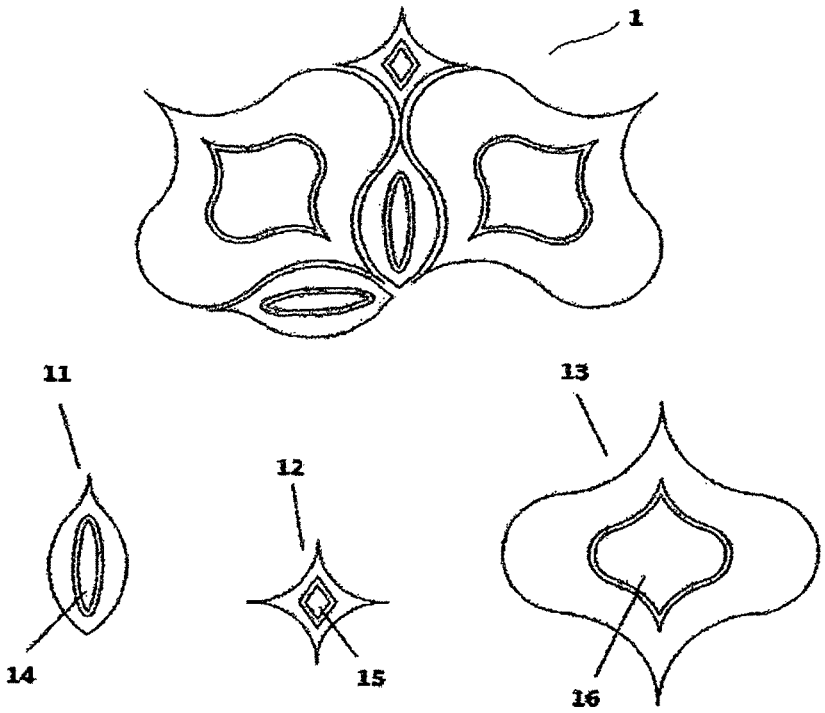
FIG. 1B – Prior Art –

METHOD FOR PRODUCING STONE INLAY TESSERAE

CROSS-REFERENCE TO RELATED APPLICATIONS

The present application claims priority to and the benefit of U.S. Provisional Patent Application Ser. No. 62/617,955, entitled A METHOD TO PRODUCE MULTI-COLOR STONE TESSERAE FOR MOSAIC PATTERN, which was filed on Jan. 16, 2018, and is hereby incorporated by reference in its entity.

FIELD OF THE INVENTION

The present disclosure generally relates to a method for producing tesserae for forming a mosaic pattern surface and, in particular, to a method for producing tesserae with a natural stone inlay and an external artificial stone layer.

BACKGROUND OF THE INVENTION

Stone mosaics have been desirable decorative art since pre-Roman times. Traditionally, stone mosaics are made from assembling small tesserae made by cutting colored glass, stone or other materials into square or triangular pieces. As the aesthetics of mosaics decoration develops, consumers now prefer stone mosaics with intricate patterns and inlay configuration. FIG. 1A shows a mosaic pattern surface of this type. As further shown in FIG. 1B, the mosaic pattern surface is usually composed of a repetition of a plurality of repeating units 1 arranged one adjacent another. Each repeating unit 1 is in turn composed of one or more tesserae 11, 12, 13, 14, 15 and 16 of different materials, shapes, colors, patterns or textures. Some tesserae 14, 15 and 16 can be inlaid within others 11, 12 and 13. A tessera is the basic unit forming the mosaic pattern surface.

Presently, there are no economic methods for efficient mass production of these basic units of stone mosaics with intricate patterns. While tesserae 14, 15 and 16 may be produced by methods such as grinding, the same methods do not apply to the production of tesserae 11, 12 and 13, as they have internal openings that must be formed by cutting. Waterjet cutting technology is commonly used to cut the tesserae with internal openings or inside cuts. However, the process is expensive and labor intensive. Each tessera has to be cut from a stone plate of a desired thickness by waterjet machines, and then glued by hand to form the repeating unit. Adding to the already high cost of waterjet cutting is the labor cost to compose the tesserae into repeating units. There are also difficulties in the precision of the cutting. A tessera may either be too big to fit into a repeating unit, or too small resulting in visible seams, slits or gaps between adjacent tesserae in a repeating unit, as shown in FIG. 1B. A need therefore exists for a method of producing tesserae or repeating units of a mosaic pattern surface that eliminates or diminishes at least some of the disadvantages and problems described above.

SUMMARY OF THE INVENTION

Provided herein is a method for producing stone inlay tesserae, the method comprises the steps of: (a) providing at least one core made from a natural stone material, the at least one core has a length in the range of 100 mm-600 mm along a longitudinal direction and a cross-section dimension in the range of 5 mm-150 mm; (b) providing a mold having an internal surface that defines an internal cavity for accommodating the at least one core, the internal cavity has a volume larger than that of the at least one core, such that an internal space is formed between the internal surface of the mold and the at least one core when the at least one core is placed within the mold; (c) adding a molding composite prepared under vacuum into the mold to fill the internal space; (d) solidifying the molding composite, thereby converting the molding composite to an artificial stone material and forming a hybrid tessera column comprising a stone inlay made from the natural stone material and an external layer made from the artificial stone material, wherein the external layer is seamlessly around the stone inlay; (e) demolding the hybrid tessera column from the mold; and (f) cutting the hybrid tessera column into a plurality of stone inlay tesserae with a multi-blade cutting machine, each stone inlay tessera has a thickness in the range of 5 mm-30 mm.

In certain embodiments, two or more cores are placed within one internal cavity of the mold.

In certain embodiments, the two or more cores are different in at least one of the following aspects: natural stone materials, profiles, colors, patterns and textures.

In certain embodiments, the external layer surrounds the entire cross-section perimeter or only a portion of the cross-section perimeter of the at least one core.

In certain embodiments, the steps (b) to (e) are repeated for two or more times using different molds so that two or more external layers are formed around the at least one core.

In certain embodiments, the two or more external layers are different in at least one of the following aspects: the artificial stone materials, profiles, colors, patterns and textures.

In certain embodiments, the external layer has a cross-section profile different from that of the core.

In certain embodiments, both the core and the external layer have intricate cross-section profiles comprising curved edges.

In certain embodiments, the natural stone material is selected from the group consisting of marble, granite, slate, sandstone, quartz stone, onyx and jade.

In certain embodiments, the molding composite comprises a mix of aggregates and bonding agents, the aggregates are selected from the group consisting of crushed marble, crushed granite, industrial residue, sand and glass; and the bonding agents are selected from the group consisting of Portland cement, aluminous cement, slag cement, unsaturated polyester, methyl methacrylate, vinyl toluene, alpha methyl styrene, para methyl styrene, diallyl phthalate, acrylic, epoxy, styrene, acrylonitrile, butadiene and dichloroethylene.

In certain embodiments, the molding composite further comprises viscosity modifier admixtures.

In certain embodiments, the molding composite is a mix of rapid hardening white cement, silica sand or quartz sand or decorative aggregates, polycarboxylate superplasticizers, re-dispersible polymer, inorganic pigments and water.

In certain embodiments, the surface of each stone inlay tesserae is subject to at least one of the following process: polishing, brushing, carving, printing, coloring, coating, tumbling and vibration.

In certain embodiments, the method further comprises the step of composing a plurality of stone inlay tesserae into a repeating unit with the plurality of stone inlay tesserae adjacent to one another.

In certain embodiments, the method further comprises the step of composing a plurality of stone inlay tesserae and a plurality of tesserae produced by casting, grinding, straight-line cutting or waterjet cutting into a repeating unit.

In certain embodiments, the method further comprises the step of gluing a plurality of stone inlay tesserae on a mesh to form a mesh mounted mosaic tile.

In certain embodiments, the method further comprises the step of gluing a plurality of stone inlay tesserae and a plurality of tesserae produced by casting, grinding, straight-line cutting or waterjet cutting on a mesh to form a mesh mounted mosaic tile.

In certain embodiments, a plurality of mesh mounted mosaic tiles are laid one adjacent another to form a mosaic pattern surface that is installed on a floor, wall, column or worktop.

BRIEF DESCRIPTION OF THE DRAWINGS

The appended drawings contain figures to further illustrate and clarify the above and other aspects, advantages and features of the present disclosure. It will be appreciated that these drawings depict only certain embodiments of the present disclosure and are not intended to limit its scope. It will also be appreciated that these drawings are not necessarily depicted to scale. The present disclosure will now be described and explained with additional specificity and detail through the use of the accompanying drawings in which:

FIGS. 1B and 1C are illustrations of repeating units for the mosaic pattern surface composed of different tesserae produced with a prior art method and a method according to certain embodiments of the present disclosure;

DETAILED DESCRIPTION OF THE INVENTION

Figure 1A:
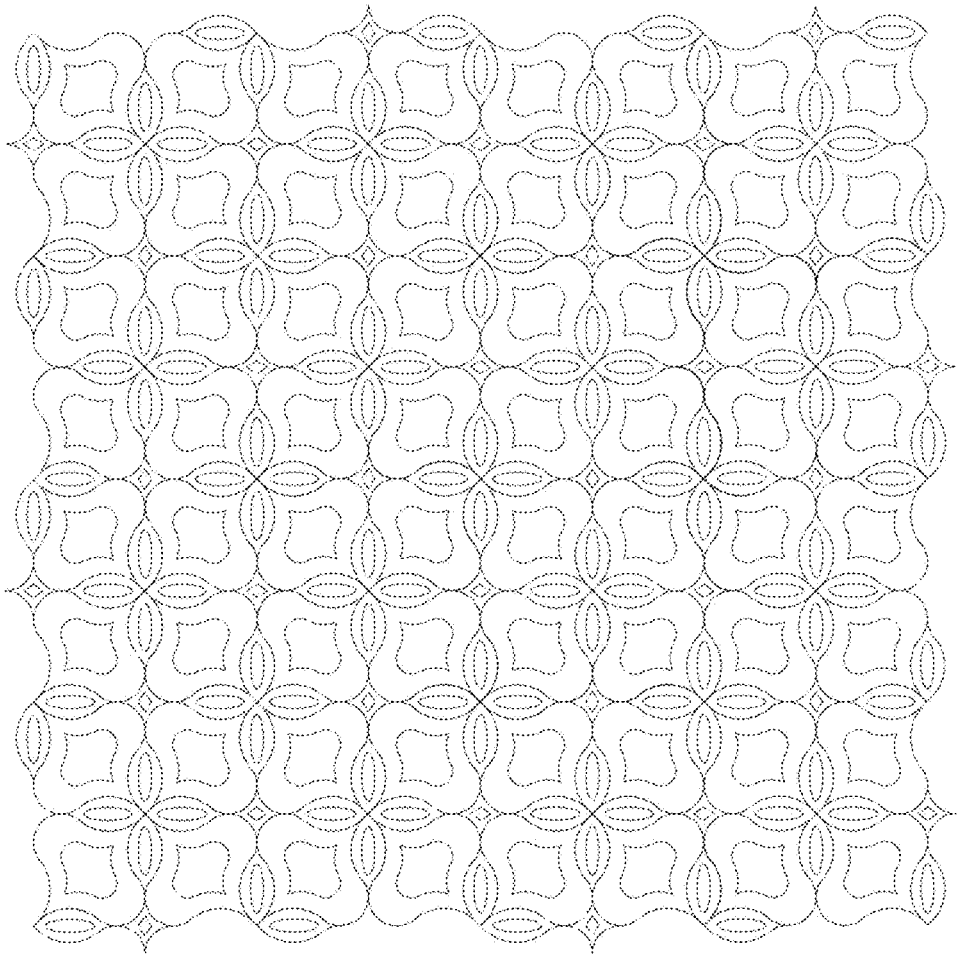
FIG. 1A is an illustration of a mosaic pattern surface of mosaics with intricate patterns and inlay configuration.
Figure 1C:
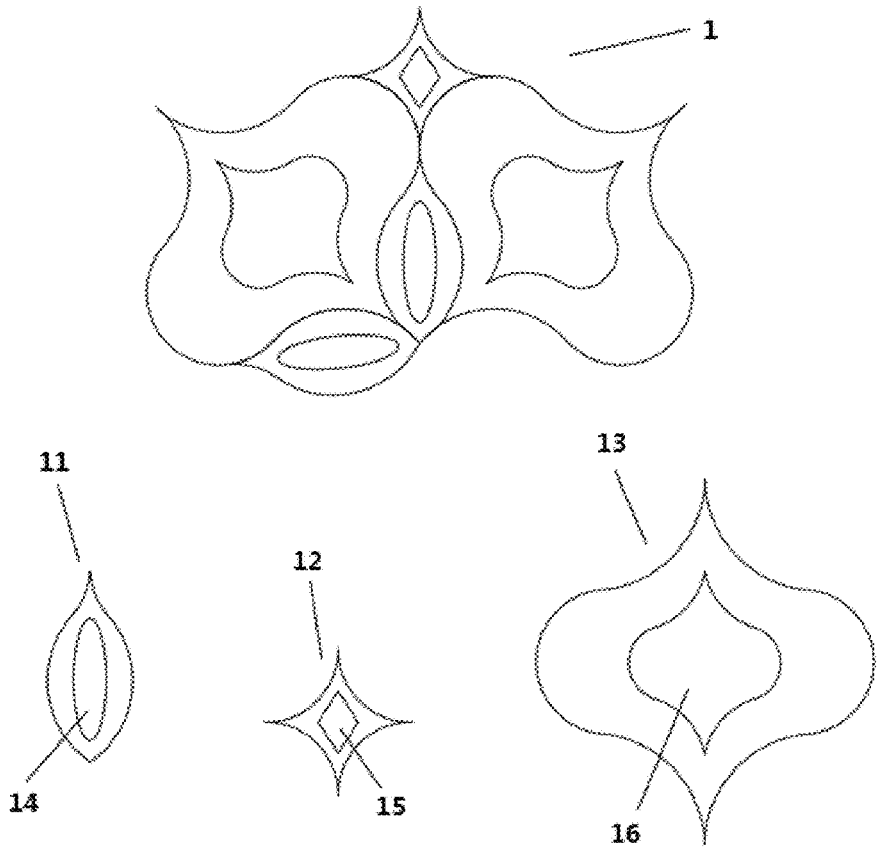

FIG. 1C shows the same repeating unit 1 of FIG. 1B produced using the method of the present disclosure. As discussed earlier, conventional waterjet cutting technology requires cutting of separate tesserae and gluing or otherwise composing them into a repeating unit. With the method of the present disclosure, it is possible to produce all tesserae (i.e. the repeating unit) or at least some of the tesserae within a repeating unit in one integral process, without the need of a subsequent composing step. In other words, it is possible to produce the stone inlay tesserae that are virtually repeating units in one integral process. Not only so, the method of the present disclosure can produce the stone inlay tesserae in a mass production scale. This is not possible using conventional methods, because the tesserae of a repeating unit have to be produced one by one. With the method of the present disclosure and the stone inlay tesserae produced therefrom, the need to composing the tesserae into a repeating unit by hand can be entirely or at least partially dispensed with. The advantages therefrom include expedient and cost effective mass production. The final product will also have a better appearance, as the stone inlay tesserae are seamless. There are no apparent seams, slits or gaps between adjacent tesserae. This advantage is clearly shown by the comparison of FIG. 1B and FIG. 1C. In FIG. 1B, the repeating unit 1 produced using a prior art method have seams between the outer tesserae 11, 12, 13 and the inner tesserae 14, 15, 16 as well as seams between adjacent outer tesserae 11, 12, 13, as represented by the space between double lines. In FIG. 1C, the repeating unit 1 produced using the method of the present disclosure does not have any such seams. Further benefits of the method of the present disclosure will be apparent from the disclosure herein.

Figure 2A:
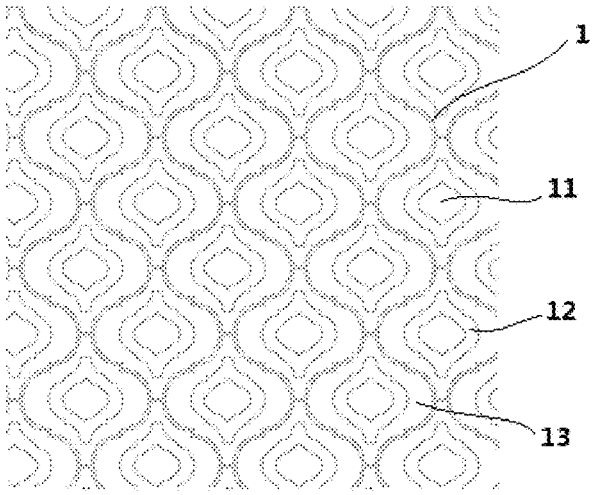
FIGS. 2A and 2B show different stone inlay tesserae produced using the production method according to certain embodiments of the present disclosure.
Figure 2B:
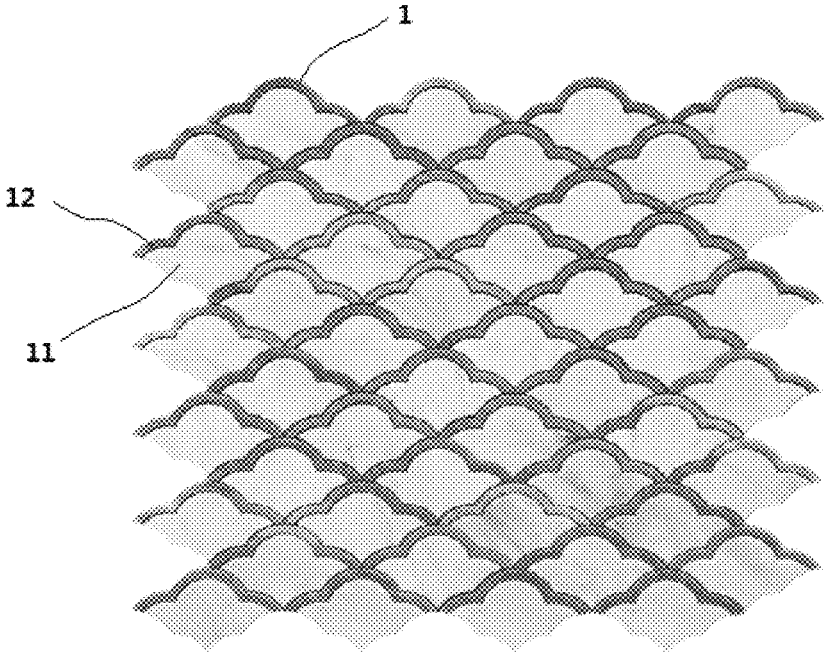

FIGS. 2A and 2B show various further examples of repeating units 1 composed of tesserae 11, 12, 13 that are produced using the method of the present disclosure. Each repeating unit 1 is composed of one or more tesserae 11, 12, 13 of the same or different kinds. For instance, FIG. 2A shows a repeating unit 1 with three different tesserae 11, 12 and 13. In certain embodiments, the most internal tessera 11 is a natural stone, while the external tesserae 12 and 13 are artificial stone. In this regard, the repeating unit 1 can also be referred to as one stone inlay tessera. An immediate benefit of the present disclosure is the reduction of costs without a significant tradeoff of the aesthetic appearance of the repeating unit 1. Because artificial stone materials are far cheaper than natural stone materials, the use of artificial stone materials to form some of the sub-tesserae 11, 12 and 13 within a repeating unit 1 can reduce the overall material costs. Further and more significant cost saving is due to the dispensing of waterjet cutting.

It is not necessary that the different sub-tesserae 11, 12 and 13 are inlaid one within another as shown in FIG. 2A. It is also possible that the different sub-tesserae 11 and 12 are stacked one on the other, or alternatively referred to as half-inlaid or partial-inlaid, as shown in FIG. 2B.

For the sake of simplicity, the method of the present disclosure will be described with reference to stone inlay tesserae each comprising an inlaid core and an external layer. However, variations and modifications within the spirit of the present disclosure are also possible.

Figure 3:
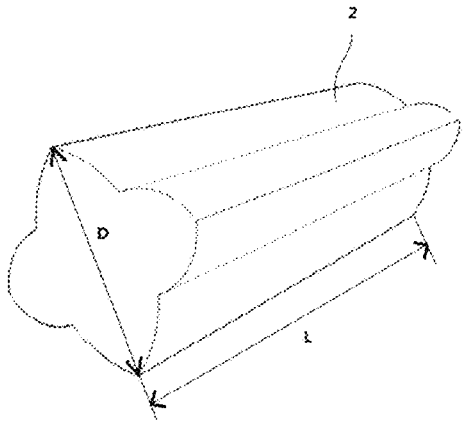
FIG. 3 shows a core to be used in the production method according to certain embodiments of the present disclosure.

As shown in FIG. 3, a core 2 in the form of a linear column is first produced. The core 2 is intended to form the inlay portion of the tesserae. The core 2 can be produced from a raw material discussed above by grinding, cutting, casting, molding or any other suitable method known in the art. In certain embodiments, the core 2 can be made of a natural stone material, such as natural marble, granite, slate, sandstone, quartz stone, onyx or jade. In certain embodiments, the core 2 can be made of artificial stone material, i.e.

a composite material made of crushed natural stone bound together by an adhesive, such as polymer resin or cement mix. In certain embodiments, the core 2 can be made of other materials, such as steel, ceramics, glass or timber. In certain embodiments, the core 2 can be made of translucent material, such as onyx, or semi-transparent material, such as resin. Other materials suitable for tesserae, tiles or other surface decorating structures are also within the contemplation of the present disclosure.

In certain embodiments, the core 2 can have a length L between 100 mm-600 mm along a longitudinal direction. In certain embodiments, the core 2 can have a length L between 150 mm-550 mm, 200 mm-500 mm, 250 mm-450 mm or 300 mm-400 mm. In certain embodiments, the core 2 can have a cross-section dimension D (the largest diametric dimension) between 5 mm-150 mm. In certain embodiments, the core 2 can have a cross-section dimension D of 10 mm-140 mm, 20 mm-130 mm, 30 mm-120 mm, 40 mm-110 mm, 50 mm-100 mm, 60 mm-90 mm, or 70 mm-80 mm. The core 2 has a consistent cross-section profile along its length. In certain embodiments, the core 2 can have a regular cross-section profile, such as a triangular, quadrilateral, pentagonal, hexagonal, heptagonal, octagonal, enneagonal or decagonal cross-section. Alternatively, the core 2 can have an intricate cross-section profile as shown in FIG. 3, such as a round, oval, star-shaped or petal-shaped cross-section. The term "intricate cross-section profile" can be generally understood as profile comprising non-linear perimeter, or curved edges, or edges that cannot be manufactured by straight-line cutting using conventional saws, blades or lathe tools.

Figure 4:
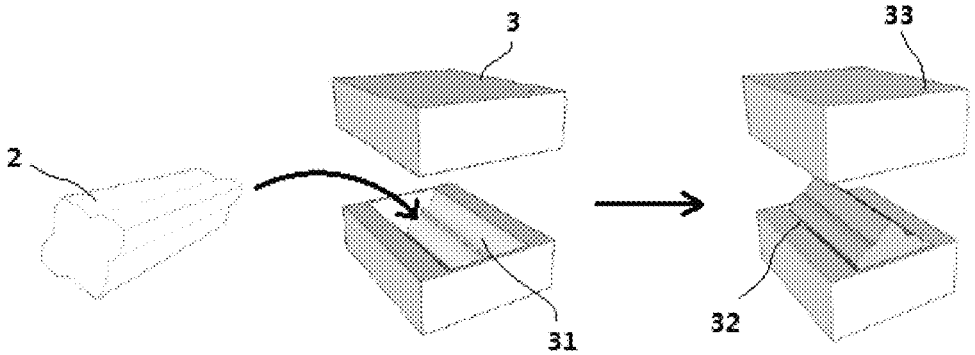
FIG. 4 shows the steps of molding an external layer around the core in a mold using the production method according to certain embodiments of the present disclosure.

Once produced, the core 2 is placed inside a mold 3 for subsequent molding of an external layer around it, as shown in FIG. 4. The mold 3 has an internal surface defining an internal cavity 31 for accommodating the core 2. The internal cavity 31 has a volume larger than that of the core 2, such that when the core 2 is placed inside the mold 3, there is an internal space 32 between the internal surface of the mold 3 and the core 2 for subsequent filling of molding composite. The internal cavity 31 is so designed that it has a consistent cross-section profile along the entire length. The cross-section profile of the internal cavity 31 is indicative of the cross-section profile of the external layer to be molded around the core 2. The internal cavity 31 can have a regular cross-section profile, such as a triangular, quadrilateral, pentagonal, hexagonal, heptagonal, octagonal, enneagonal or decagonal cross-section. Alternatively, the internal cavity 31 can have an intricate cross-section profile as shown, such as a round, oval, star-shaped or petal-shaped cross-section. In certain embodiments, the internal cavity 31 is so designed that the internal space 32 is uniform around the entire perimeter of the cross-section of the core 2, resulting an external layer of even thickness. The external layer will then have a cross-section profile that is substantially similar to that of the core 2, only larger in cross-section dimension. In certain embodiments, the internal cavity 31 is so designed that the internal space 32 is not uniform around the perimeter of the cross-section of the core 2. The molded external layer will then have a cross-section profile that is different from that of the core 2. In certain embodiments, the internal cavity 31 is so designed that the internal space 32 extends only partly around the perimeter of the core 2. The core 2 is then only partially inlaid within the external layer.

Having closed and sealed the mold 3, a molding composite for forming the external layer is prepared as a slurry or flowable paste and then poured or injected into the internal cavity 31 of the mold 3 through one or more sprues 33 in the mold 3. The molding composite can be solidified and converted into an artificial stone material, so that the artificial stone material can have uneven pigments or granules resembling a natural stone material. The physical properties of the artificial stone material are also similar to those of the natural stone material, for example in terms of hardness, compressive strength and flexural strength (e.g. 1000-3000 psi). In certain embodiments, the artificial stone material is water resistant. In certain applications, the artificial stone material can have a Mohs hardness between 2 (such as concrete) and 3 (such as marble). In certain applications such as bathroom wall, the artificial stone material can have an even lower Mohs hardness. In certain embodiments, the molding composite is a mix of aggregates, bonding agents. The aggregates can comprise coarse aggregates such as crushed marble, granite, industrial residue and glass, and/or fine aggregates, such as sand. The bonding agents can be hydraulic cement, such as Portland cement, aluminous cement, slag cement and various blended hydraulic cements; or organic adhesives such as resin (e.g. unsaturated polyester), methyl methacrylate (MMA), vinyl toluene (VT), alpha methyl styrene (AMS), para methyl styrene (PMS), diallyl phthalate (DAP), acrylic, epoxy, styrene, acrylonitrile, butadiene and dichloroethylene. In certain embodiments, the molding composite further comprises solvent. The solvent can be water or organic solvents, such as Methyl ethyl ketone (MEK), turpentine (white spirit), methylated spirits (mixture of methanol and ethanol), xylene, toluene and acetone. In certain embodiments, the molding composite can further comprise viscosity modifier admixtures (such as Sika VMA) to avoid segregation when a long column is molded. The composition of the molding composite can be varied according to the different applications of the tesserae so produced. For instance, a higher water resistance property of tesserae may be desirable in bathroom applications, while a higher hardness of tesserae may be preferred in kitchen applications. In one embodiment, the molding composite is a mixture of the following materials (w/w): 500 parts of rapid hardening white cement (e.g. AALBORG PW 52.5), 500 parts of silica sand or quartz sand or decorative aggregates (e.g. marble or glass), 3 parts of polycarboxylate superplasticizers (e.g. Sika® ViscoCrete), 30 parts of redispersible polymer (e.g. vinyl acetate ethylene (VAE) copolymers or styrene-butadiene copolymer resin (SBR) or acrylate copolymers), 20 parts of inorganic pigments (e.g. Ferro® inorganic pigments), and 160 parts of water or other solvent. In certain embodiments, the molding composite is prepared by blending the aforesaid constituents under vacuum (e.g. 10 kPa or below), or undergoing a degassing process before it is injected or poured into the mold.

The injection takes place by filling the molding composite into the internal cavity 31 of the mold 3 from bottom up, so that the molding composite will push out any air inside the internal cavity 31 of the mold 3. As a result, air bubbles that may appear in the finished product can be minimized. Air bubbles on the surface or inside will affect the aesthetic appearance of the finished product. They are also likely to significantly reduce the strength and durability of the finished product.

Figure 5:
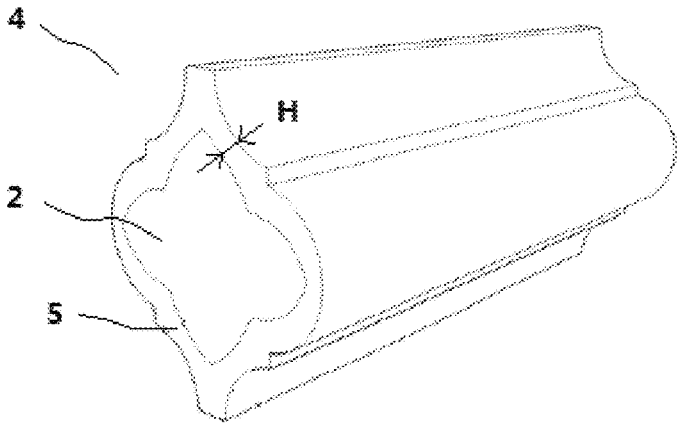
FIG. 5 shows a demolded hybrid tessera column produced using the production method according to certain embodiments of the present disclosure.

The molding composite solidifies in the mold at room temperature for a period between around 15 minutes to around 30 minutes, and is left in the mold for another 4 to 6 hours to build up a good handling strength. Post molding, a hybrid tessera column 4 is formed and demolded from the mold 3. As shown in FIG. 5, the hybrid tessera column 4 comprises a core 2 and an external layer 5 around the core 2. In the embodiment as shown in FIG. 5, the external layer 5 has a relative small thickness H around the perimeter, as compared with the cross-section dimension of the core 2. However, the thickness H can be as large as, or larger than the cross-section dimension of the core 2. The external layer 5 has a cross-section profile that is intricate and different from the cross-section profile of the core 2. Although the external layer 5 is shown to surround the entire perimeter of the core 2 such that the core 2 is completely inlaid within the external layer 5, it is also possible that the external layer 5 surrounds only a portion of the perimeter of the core 2 such that the core 2 is only partially inlaid within the external layer 5. In addition, although not shown in FIG. 5, the core 2 and the external layer 5 can be of different colors, patterns, textures or other characteristics.

Figure 6:
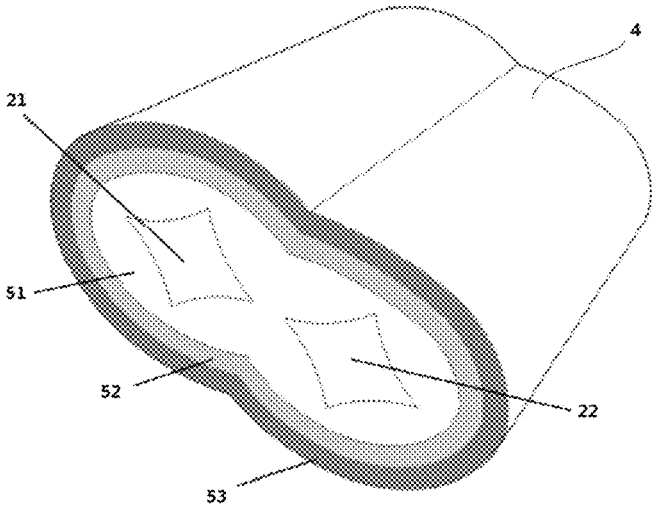
FIG. 6 shows a further demolded hybrid tessera column produced using the production method according to certain embodiments of the present disclosure.
Figure 7:
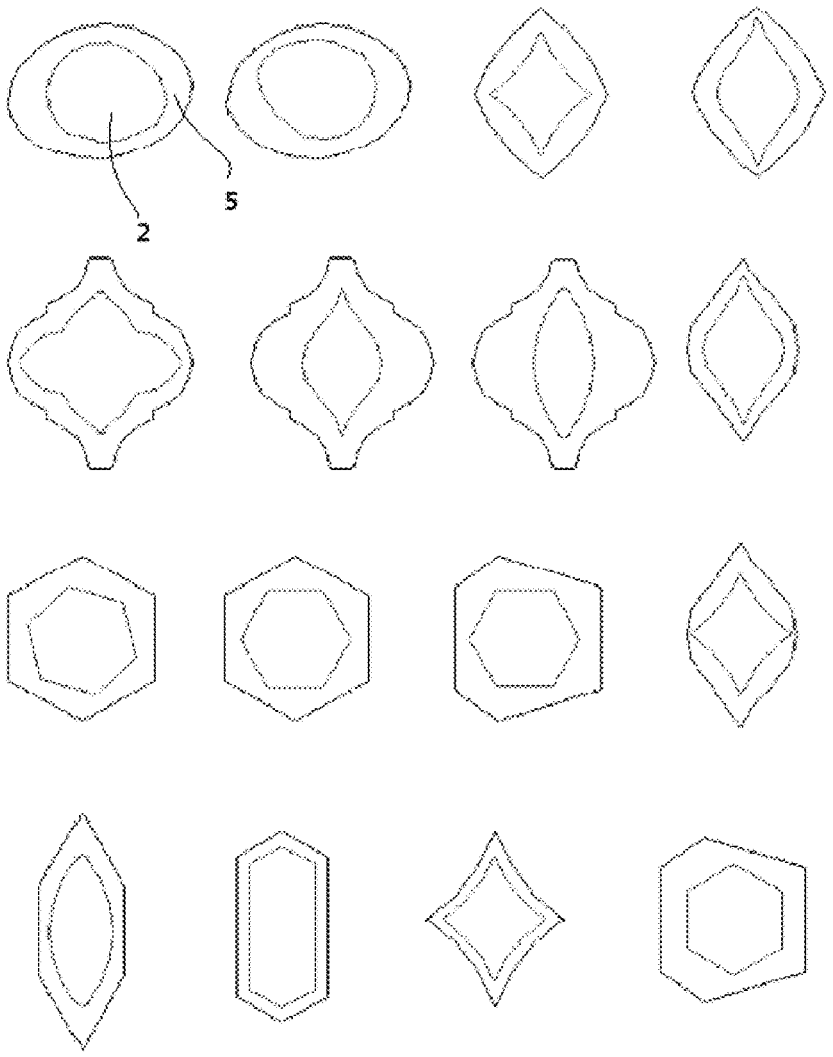
FIG. 7 shows various cross-sections of a hybrid tessera column produced using the production method according to certain embodiments of the present disclosure.
Figure 8:
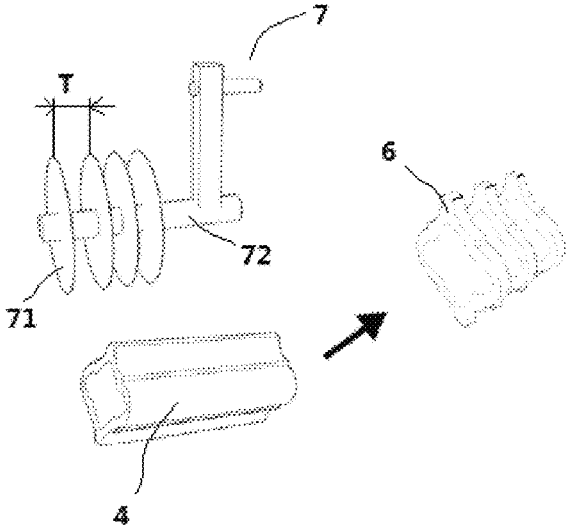
FIG. 8 shows a hybrid tessera column is sliced into individual tesserae using the production method according to certain embodiments of the present disclosure.

It is not intended by the present disclosure to impose any restrictions on the number of cores 2 or the number of external layers 5 of a hybrid tessera column 4. In certain embodiments as shown in FIG. 6, the hybrid tessera column 4 has two cores 21, 22 and three external layers 51, 52, 53. To produce a hybrid tessera column 4 of this type, three different molds 3 are needed, each for molding a respective external layer 51, 52, 53. In other words, having molded the first external layer 51, the intermediate hybrid tessera column is then placed within a second mold to mold the second external layer 52 around the intermediate hybrid tessera column, and the process is repeated until all external layers 51, 52, 53 have been molded. The molds 3 are suitable for accommodating two cores 21, 22 side by side. The two cores 21, 22 can be of the same or different materials, profiles, colors, patterns, textures or any other characteristics. Likewise, the three external layers 51, 52, 53 can be of the same or different materials, profiles, colors, patterns, textures or any other characteristics. The number of cores 2 can be two, three, four, five, six, seven, eight, nine, ten or any other plural number. Likewise, the number of external layers 5 can be two, three, four, five, six, seven, eight, nine, ten or any other plural number. As such, a hybrid tessera column 4 having cores 2 and external layers 5 with various combinations of profiles, colors, patterns, textures or other characteristics can be produced, as shown in FIG. 7.

In certain embodiments, the demolded hybrid tessera column 4 is further cured for up to 7 days. The hybrid tessera column 4 is then cut into individual pieces of stone inlay tesserae 6. In certain embodiments, this is done by a multi-blade cutting machine 7. The multi-blade cutting machine 7 comprises a plurality of blades 71 spaced at an interval T along the longitudinal direction. The plurality of blades 71 are rotated by a common shaft 72 which is in turn driven by a motor (not shown). The blades can have a circular or linear configuration. They are moved to slice through the hybrid tessera column 4 in a direction perpendicular to the longitudinal axis of the hybrid tessera column 4. As a result, the hybrid tessera column 4 is cut into separate pieces of tesserae 6 by one cutting step. The interval T will also be the thickness of each stone inlay tessera 6 that is cut from the hybrid tessera column 4 by the multi-blade cutting machine 7. In certain embodiments, the thickness T is in the range of 5 mm to 30 mm. In certain embodiments, the thickness T is in the range of 6 mm to 25 mm, 7 mm to 20 mm, 8 mm to 15 mm, 9 mm to 13 mm, or 11 mm. Each stone inlay tesserae 6 can have a cross-section dimension of a few millimeters to close to one meter. In certain embodiments, each stone inlay tessera 6 can have a cross-section dimension in the range of 10 mm to 1000 mm, 20 mm to 800 mm, 40 mm to 600 mm, 60 mm to 400 mm, 80 mm to 200 mm, 100 mm to 160 mm, or 120 mm to 140 mm.

In this way, a plurality of stone inlay tesserae 6 can be produced in one cutting step. Given a hybrid tessera column 4 of 500 mm long, around 50-100 stone inlay tesserae 6 can be produced in one cutting process. This is a significant improvement in production efficiency, as compared with production by waterjet cutting technology. In certain embodiments, the stone inlay tesserae 6 produced using the method of the present disclosure are self-repeating. They are equivalent of the repeating units manually composed of multiple tesserae that are cut by waterjet cutting technology. Therefore, the method of the present disclosure can dispense with the need to manually compose different tesserae to form a repeating unit. As the stone inlay tesserae 6 are produced to have at least one core inlaid within at least one external layer, they are not distinguishable from traditional repeating units composed from a plurality of waterjet cut tesserae by hand, in terms of visual appearance. As a matter of fact, the stone inlay tesserae 6 of the present disclosure will have a better visual appearance because the seams between the core 2 and the external layer 5 are hardly noticeable. Even where the stone inlay tesserae 6 produced using the method of the present disclosure are only used as a part of a repeating unit, they at least partly dispenses with the need to manually compose different tesserae to form a repeating unit, which is usually very time consuming and labor intensive.

Due to the possibility to use multiple cores and multiple external layers of different materials, intricate profiles, colors, patterns, textures, the possibility to completely or partially inlay the cores 2 within the external layers 5, and the possibility to provide seamless connection between the cores 2 and the external layers 5, the method of the present disclosure is able to produce a significant number of different stone inlay tesserae 6 of high aesthetic value.

The individual tesserae 6 may be subject to further processes if desired. In certain embodiments, the individual tesserae 6 will be surface polished, brushed, carved, printed, colored, coated, tumbled, vibrated or subject to other process to modify or improve the surface hardness, texture, color, pattern, or other characteristics. In certain embodiments, the improvement includes taking away saw marks on the surface of the individual tesserae 6. In certain embodiments, the improvement includes providing a matt, old, aged, antiqued visual appearance of the individual tesserae 6 or other visual appearance that is desirable in the market.

Figure 9:
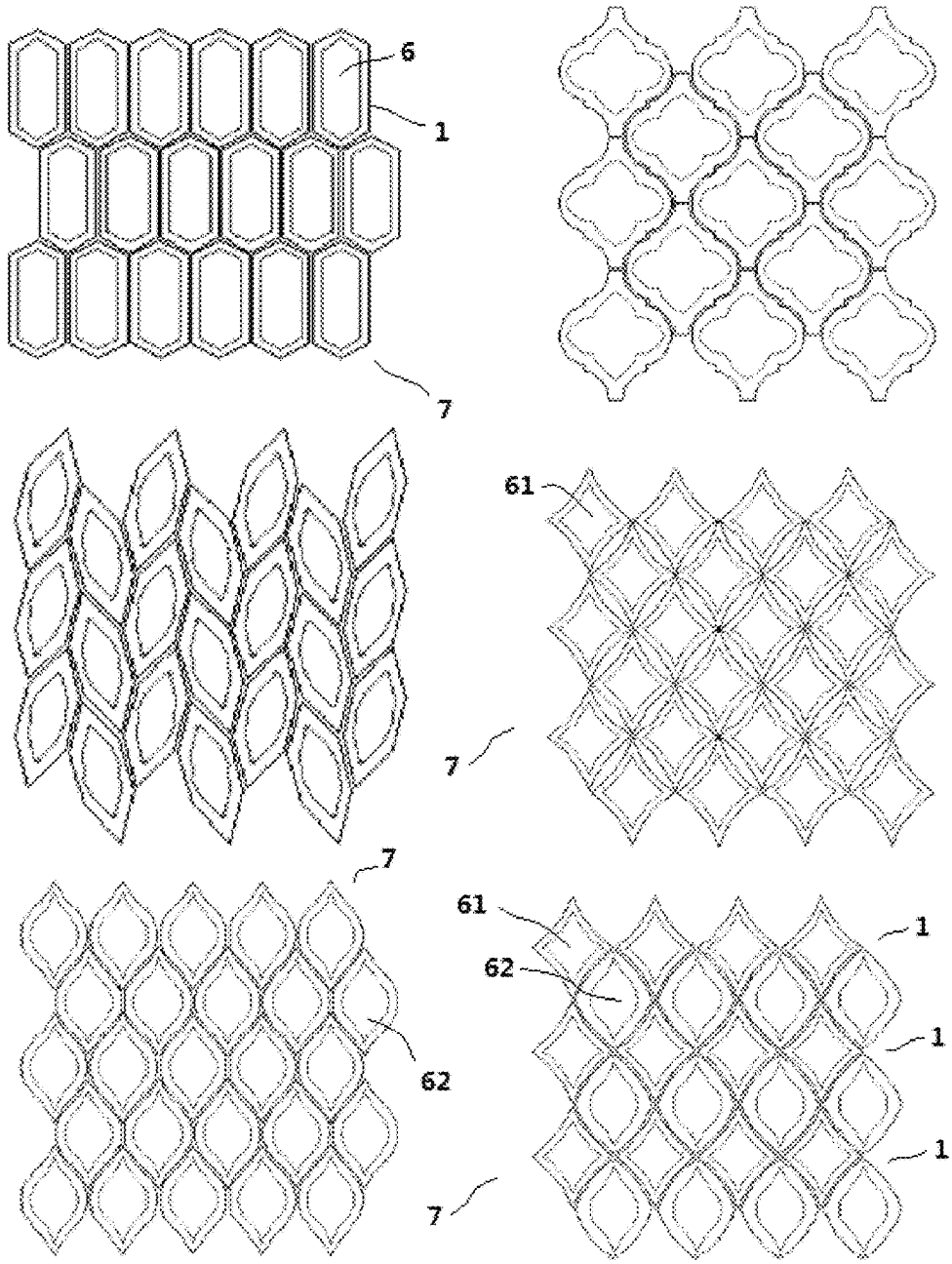
FIG. 9 shows tiles piled up of multiple repeating units composed of tesserae produced using the production method according to certain embodiments of the present disclosure.

The individual stone inlay tesserae 6 so produced, alone or with other types of stone inlay tesserae produced using the same method, or with other tesserae produced using traditional methods, such as casting, grinding, straight-line cutting or waterjet cutting technology, and from any materials, such as natural stone, artificial stone, glass, metal and resin, can be used to form repeating units 1, as shown in FIG. 9. A repeating unit 1 can comprise one or more stone inlay tesserae 6 of a single kind, or a repeating unit 1 can comprises multiple stone inlay tesserae 61, 62 of different kinds. The repeating units 1 are configured such that they can be laid one next to another to form a mosaic pattern surface that is installed on a floor, wall, column, worktop or any other suitable objects. Alternatively, multiple stone inlay tesserae 6, repeating units 1, or multiple stone inlay tesserae 6 together with other tesserae produced using traditional methods, such as casting, grinding, straight-line cutting or waterjet cutting technology, and from any materials, such as natural stone, artificial stone, glass, metal and resin, can first be glued onto a mesh (not shown) forming a mesh mounted mosaic tile 7, and the tiles 7 can be laid one next to another to form the mosaic pattern surface. In certain embodiments, each tile 7 has a size of around 1 to 2 square foot for easy handling.

Figure 10:
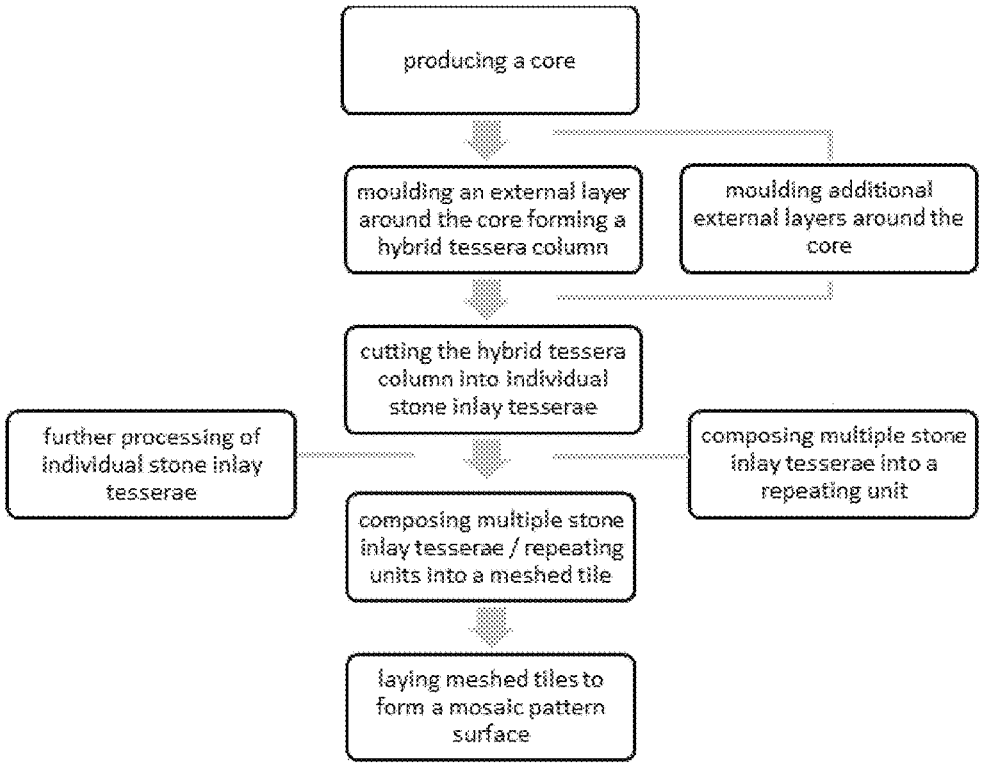
FIG. 10 shows a workflow of the production method according to certain embodiments of the present disclosure.
Figure 11:
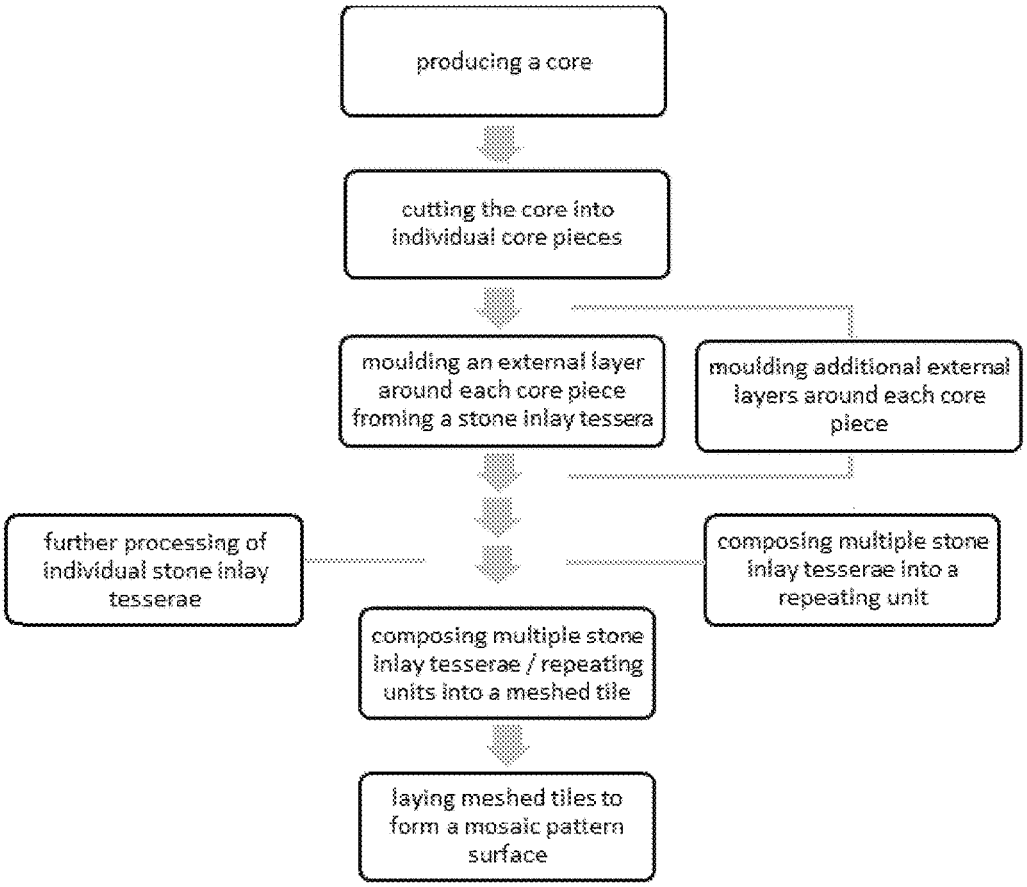
FIG. 11 shows a further workflow of the production method according to certain embodiments of the present disclosure.
Figure 12:
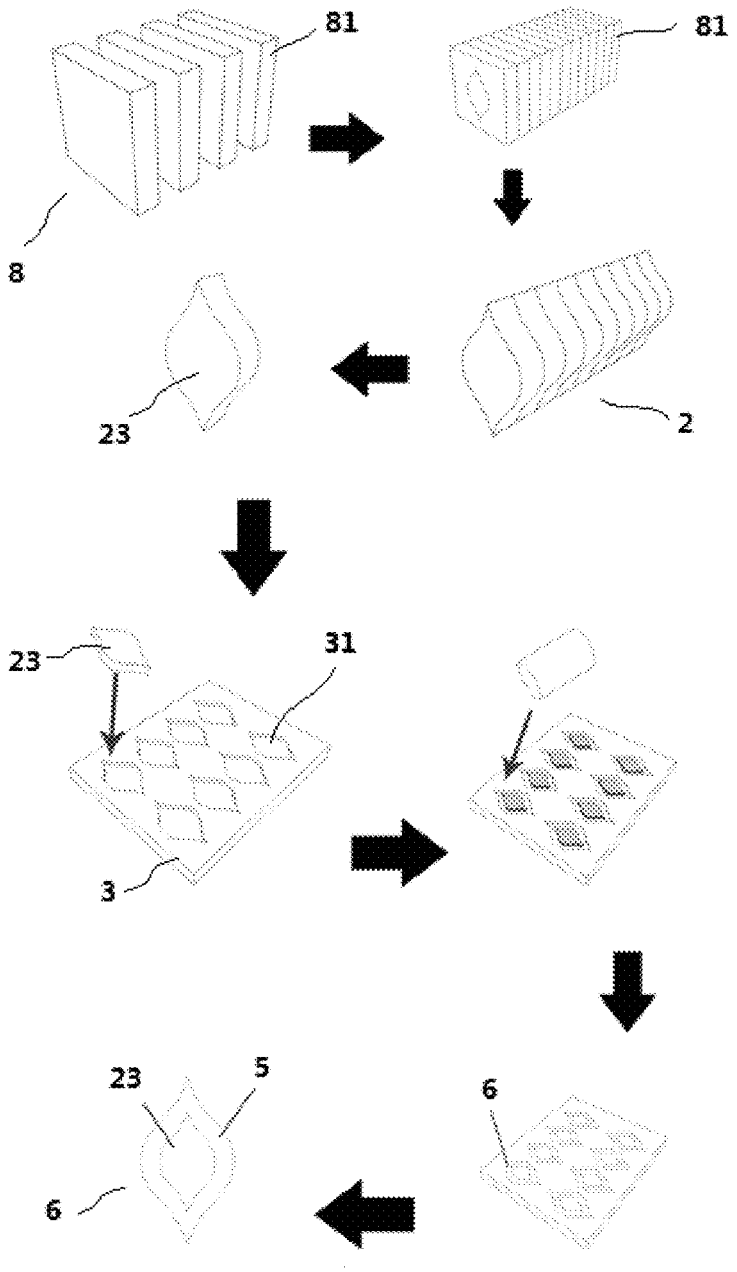
FIG. 12 shows the workflow of the production method of FIG. 11.

FIG. 10 shows the various steps underwent to produce the stone inlay tesserae and mosaic pattern surface using the method of the present disclosure. In certain embodiments, the steps may be carried in a different order. For instance, as shown in FIGS. 11 and 12, before any molding process, a longitudinal stone piece 8 can be cut by a multi-blade cutting machine 7 into many individual pieces 81 and then grinded to individual core pieces 23 of a desirable profile. Alternatively, the longitudinal stone piece 8 can be grinded into a core 2 of a desirable profile and then cut by a multi-blade cutting machine 7 into many individual core pieces 23. The resultant individual core pieces 23 can then be molded concurrently in a mold 3. For this purpose, the mold 3 comprises a plurality of (e.g. 50 to 100) internal cavities 31 for accommodating the core pieces 23. Likewise, one or more core pieces 23 may be placed in the same internal cavity for 31 molding, and one or more complete or partial external layers 5 can be molded around each core piece. As such, stone inlay tesserae 6 can be directly molded.

With the method as shown in FIG. 11, it is possible not only to produce tesserae for mosaic patterning, but also to produce medallions, panels, table tops, bar tops, show bases, light covers, or any other flat decorative surfaces that have specially designed patterns. Where heat forming materials, such as thermosetting plastics, are used instead of the artificial stone materials, the method will allow forming a more flexible shape or configuration with stone inlay. In certain embodiments, the method allows production of the whole bathtubs, bowls and sinks.

One of ordinary skill in the art will appreciate after reviewing this disclosure that the method may have other suitable steps, processes and arrangements of steps or processes. Although the present disclosure has been described in terms of certain embodiments, other embodiments apparent to those of ordinary skill in the art are also within the scope of this invention. Accordingly, the scope of the invention is intended to be defined only by the claims which follow.

What is claimed is:

1. A method for producing stone inlay tesserae, comprising the steps of:

(a) providing at least one core made from a natural stone material, the at least one core has a length in the range of 100 mm-600 mm along a longitudinal direction and a cross-section dimension in the range of 5 mm-150 mm;

(b) providing a mold having an internal surface that defines an internal cavity for accommodating the at least one core, the internal cavity has a volume larger than that of the at least one core, such that an internal space is formed between the internal surface of the mold and the at least one core when the at least one core is placed within the mold;

(c) adding a molding composite prepared under vacuum into the mold to fill the internal space;

(d) solidifying the molding composite, thereby converting the molding composite to an artificial stone material and forming a hybrid tessera column comprising a stone inlay made from the natural stone material and an external layer made from the artificial stone material, wherein the external layer is seamlessly around the stone inlay;

(e) demolding the hybrid tessera column from the mold; and (f) cutting the hybrid tessera column into a plurality of stone inlay tesserae with a multi-blade cutting machine, each stone inlay tessera has a thickness in the range of 5 mm-30 mm, wherein both the at least one core and the external layer have intricate cross-section profiles comprising curved edges, the external layer has a cross-section profile different from that of the at least one core, and wherein the external layer surrounds the entire cross-section perimeter or only a portion of the cross-section perimeter of the at least one core.

2. The method of claim 1, wherein two or more cores are placed within one internal cavity of the mold.

3. The method of claim 2, where the two or more cores are different in at least one of the following aspects: natural stone materials, profiles, colors, patterns and textures.

4. The method of claim 1, wherein steps (b) to (e) are repeated for two or more times using different molds so that two or more external layers are formed around the at least one core.

5. The method of claim 4, wherein the two or more external layers are different in at least one of the following aspects: the artificial stone materials, profiles, colors, patterns and textures.

6. The method of claim 1, wherein the natural stone material is selected from the group consisting of marble, granite, slate, sandstone, quartz stone, onyx and jade.

7. The method of claim 1, wherein the molding composite comprises a mix of aggregates and bonding agents, the aggregates are selected from the group consisting of crushed marble, crushed granite, industrial residue, sand and glass; and the bonding agents are selected from the group consisting of Portland cement, aluminous cement, slag cement, unsaturated polyester, methyl methacrylate, vinyl toluene, alpha methyl styrene, para methyl styrene, diallyl phthalate, acrylic, epoxy, styrene, acrylonitrile, butadiene and dichloroethylene.

8. The method of claim 7, wherein the molding composite further comprises viscosity modifier admixtures.

9. The method of claim 1, wherein the molding composite is a mix of rapid hardening white cement, silica sand or quartz sand or decorative aggregates, polycarboxylate superplasticizers, re-dispersible polymer, inorganic pigments and water.

10. The method of claim 1, wherein the surface of each stone inlay tesserae is subject to at least one of the following processes: polishing, brushing, carving, printing, coloring, coating, tumbling and vibration.

11. The method of claim 1, further comprising the step of composing the plurality of stone inlay tesserae into a repeating unit with the plurality of stone inlay tesserae adjacent to one another.

12. The method of claim 1, further comprising the step of composing the plurality of stone inlay tesserae and a plurality of tesserae produced by casting, grinding, straight-line cutting or waterjet cutting into a repeating unit.

13. The method of claim 1, further comprising the step of gluing the plurality of stone inlay tesserae on a mesh to form a mesh mounted mosaic tile.

14. The method of claim 13, wherein a plurality of mesh mounted mosaic tiles are laid one adjacent another to form a mosaic pattern surface that is installed on a floor, wall, column or worktop.

15. The method of claim 1, further comprising the step of gluing the plurality of stone inlay tesserae and a plurality of tesserae produced by casting, grinding, straight-line cutting or waterjet cutting on a mesh to form a mesh mounted mosaic tile.

* * * * *